US007486899B2

(12) United States Patent
Choi et al.

(10) Patent No.: US 7,486,899 B2
(45) Date of Patent: Feb. 3, 2009

(54) FUSING UNIT AND FUSING APPARATUS USING THE SAME

(75) Inventors: Min-goo Choi, Gunpo-si (KR); Kyung-shig Chung, Suwon-si (KR); Sung-hoon Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 304 days.

(21) Appl. No.: 11/434,133

(22) Filed: May 16, 2006

(65) Prior Publication Data

US 2007/0019974 A1 Jan. 25, 2007

(30) Foreign Application Priority Data

Jul. 21, 2005 (KR) ..... 10-2005-0066370

(51) Int. Cl.
*G03G 15/20* (2006.01)
*G03G 15/00* (2006.01)
*G03G 15/16* (2006.01)

(52) U.S. Cl. ..... 399/33; 399/69; 399/88; 399/90; 399/122

(58) Field of Classification Search ..... 399/33, 399/69, 90, 88, 122
See application file for complete search history.

(56) References Cited

U.S. PATENT DOCUMENTS

| | | | | |
|---|---|---|---|---|
| 6,075,228 | A * | 6/2000 | Goto et al. | 219/216 |
| 6,661,992 | B2 | 12/2003 | Lee | |
| 2002/0130945 | A1 * | 9/2002 | Samei et al. | 347/156 |
| 2004/0047660 | A1 * | 3/2004 | Kim et al. | 399/330 |

FOREIGN PATENT DOCUMENTS

| | | |
|---|---|---|
| JP | 57-060362 | 4/1982 |
| JP | 61-032082 | 2/1986 |
| JP | 03-144682 | 6/1991 |
| JP | 2004-240365 | 8/2004 |

* cited by examiner

*Primary Examiner*—David M Gray
*Assistant Examiner*—Joseph S. Wong
(74) *Attorney, Agent, or Firm*—Roylance, Abrams, Berdo & Goodman, L.L.P.

(57) ABSTRACT

A fusing unit and a fusing apparatus using the fusing unit are provided. The fusing unit includes a pipe-shaped fusing roller having a heat generating unit and electrode members at both ends thereof. A power supply unit contacts the electrode members and supplies current thereto. A blocking member is disposed between the electrode members and the power supply units to block current by separating the power supply unit from the electrode members when a temperature of the heat generating unit rapidly increases.

17 Claims, 5 Drawing Sheets

FUSING UNIT AND FUSING APPARATUS USING THE SAME

CROSS-REFERENCE TO RELATED PATENT APPLICATION

This application claims the benefit under 35 U.S.C. § 119 (a) of Korean Patent Application No. 10-2005-0066370, filed on Jul. 21, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a fusing apparatus having current blocking means blocking current applied to a heating roller to substantially prevent overheating of the heating roller, and an image forming apparatus using the fusing apparatus.

2. Description of Related Art

Generally, a color image forming apparatus using an electrophotography scheme is an apparatus for forming a color image by irradiating light on a photosensitive medium charged with a predetermined electric potential to form an electrostatic latent image corresponding to an image. The electrostatic latent image is developed with predetermined color toners. The developed image is transferred and fused on a print medium.

FIG. 1 is a longitudinal cross sectional view schematically showing a construction of a conventional fusing apparatus.

Referring to FIG. 1, a fusing apparatus 10 includes a fusing unit 11 and a pressing roller 15 facing the fusing unit 11.

The fusing unit 11 is a unit applying heat to a toner image transferred on a print medium 17 and includes a pipe-shaped cylindrical fusing roller 12 and a heat generating unit 14 generating heat by using current transmitted from an external power supply (not shown) provided to an inner side of the fusing roller 12.

A release layer 13, which is preferably made of an elastic material to improve releasability to the toner image, is provided on a circumferential surface of the fusing roller 12.

Radiation energy (heat) generated by the heat generating unit 14 is transmitted to the fusing roller 12 through air charged in an inner portion of the fusing roller 12 and converted to thermal energy by an opto-thermal conversion layer (not shown) coated on an inner side surface of the fusing roller 12 to heat the fusing roller 12, and then the release layer 13 is heated up to a predetermined fusing temperature due to thermal conduction.

A pressing roller 15 facing the fusing unit 10 through a print medium 17 is disposed under the fusing unit 11. The pressing roller 15 is elastically supported by a spring member 16 to press the print medium 17 passing between the fusing unit 10 and the pressing roller 15 toward the fusing unit 11.

At this time, the powder-state toner image 18 transferred on the print medium 17 is pressed and heated with predetermined pressure and heat while the print medium 17 passes between the fusing unit 11 and the pressing roller 15. The toner image 18 is fused on the print medium 17 with predetermined temperature heat and pressure by the fusing unit 11 and the pressing roller 15.

A thermostat 20 is disposed over the fusing unit 11 for stopping power supply to prevent overheating of the surface temperature of the release layer 13 when the surface temperature rapidly increases. A thermistor 30 is disposed over the fusing unit 11 for measuring the surface temperatures of the fusing roller 12 and the release layer 13.

However, the thermostat 20 is located at a position separated from the fusing unit 11 by a distance of about 1 mm to 2 mm, and a temperature of a surface of the release layer 13 is not directly sensed. Instead, the thermostat 20 measures a temperature of air heated around the release layer 13.

Therefore, due to the separation of the thermostat 20 and the fusing unit 11, response capability is deteriorated, and the power supply cannot be instantaneously blocked when an abnormal state occurs due to actual overheating. Thus, a problem exists that an emergency, such as a fire, may occur.

Therefore, a need exists for an image forming apparatus having an improved fusing unit adapted to substantially block current transfer when a temperature of the fusing roller rapidly increases.

SUMMARY OF THE INVENTION

The present invention provides a fusing apparatus having current blocking means that have an improved response capability to instantaneously block current supplied to a heat generating unit in an abnormal state where a temperature of a fusing roller rapidly increases, and an image forming apparatus using the fusing apparatus.

A fusing unit includes a pipe-shaped fusing roller having a heat generating unit and electrode members at both ends thereof. A power supply unit contacts the electrode members and supplies current thereto. A blocking member is disposed between the electrode members and the power supply units to block current by separating the power supply unit from the electrode members when a temperature of the heat generating unit rapidly increases.

Other objects, advantages, and salient features of the invention will become apparent from the detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
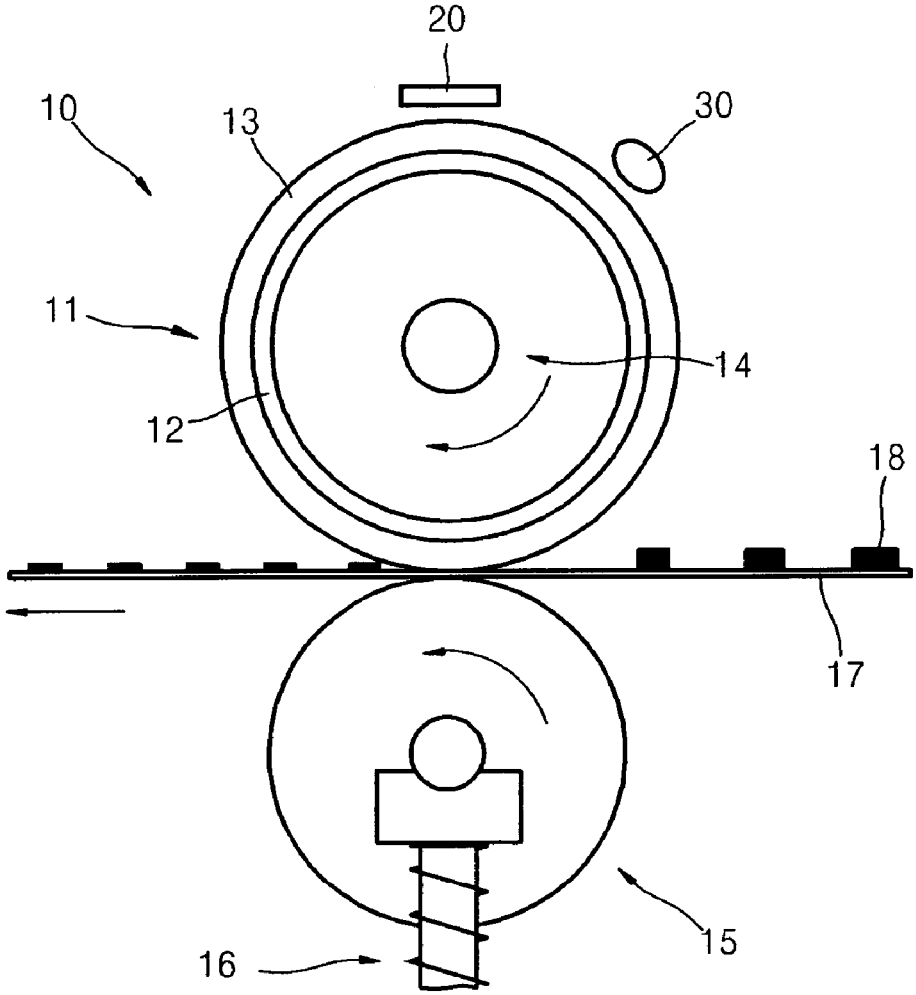
FIG. 1 (PRIOR ART)
FIG. 1 is a longitudinal cross sectional view schematically showing a a conventional fusing apparatus.
Figure 2:
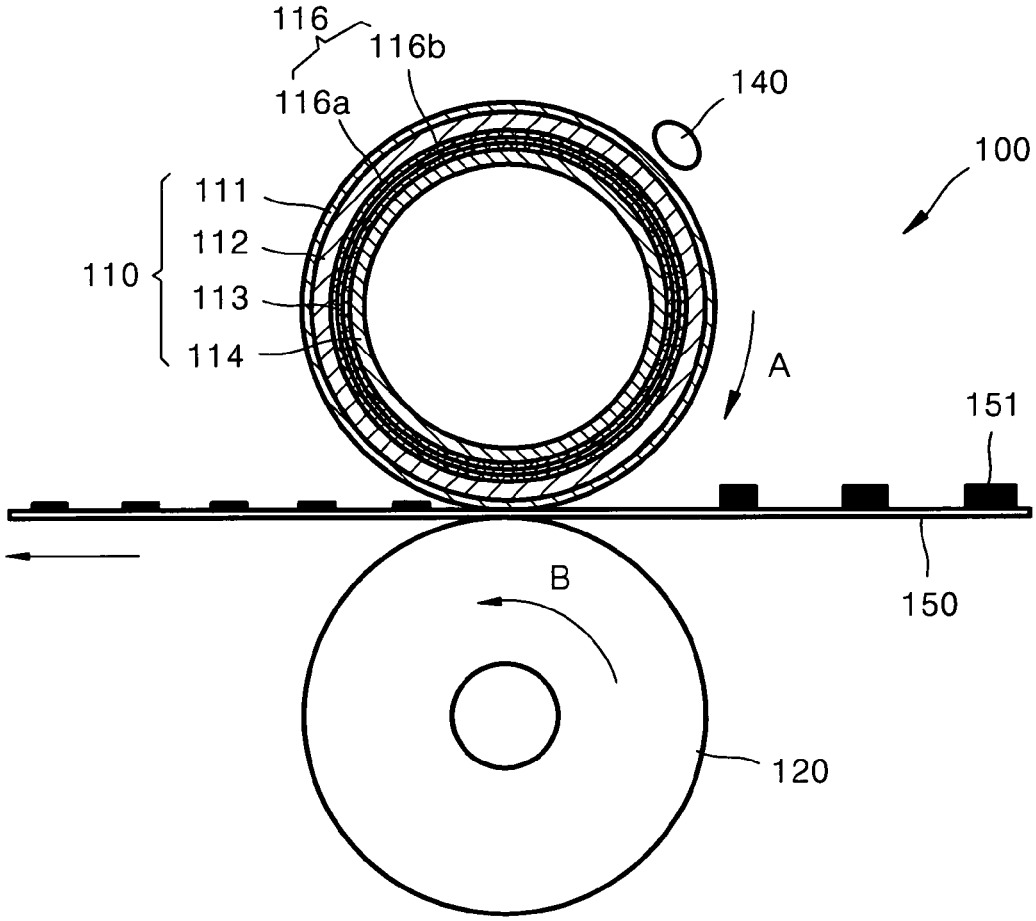
FIG. 2 is a longitudinal cross sectional view of a fusing apparatus according to an exemplary embodiment of the present invention.
Figure 3:
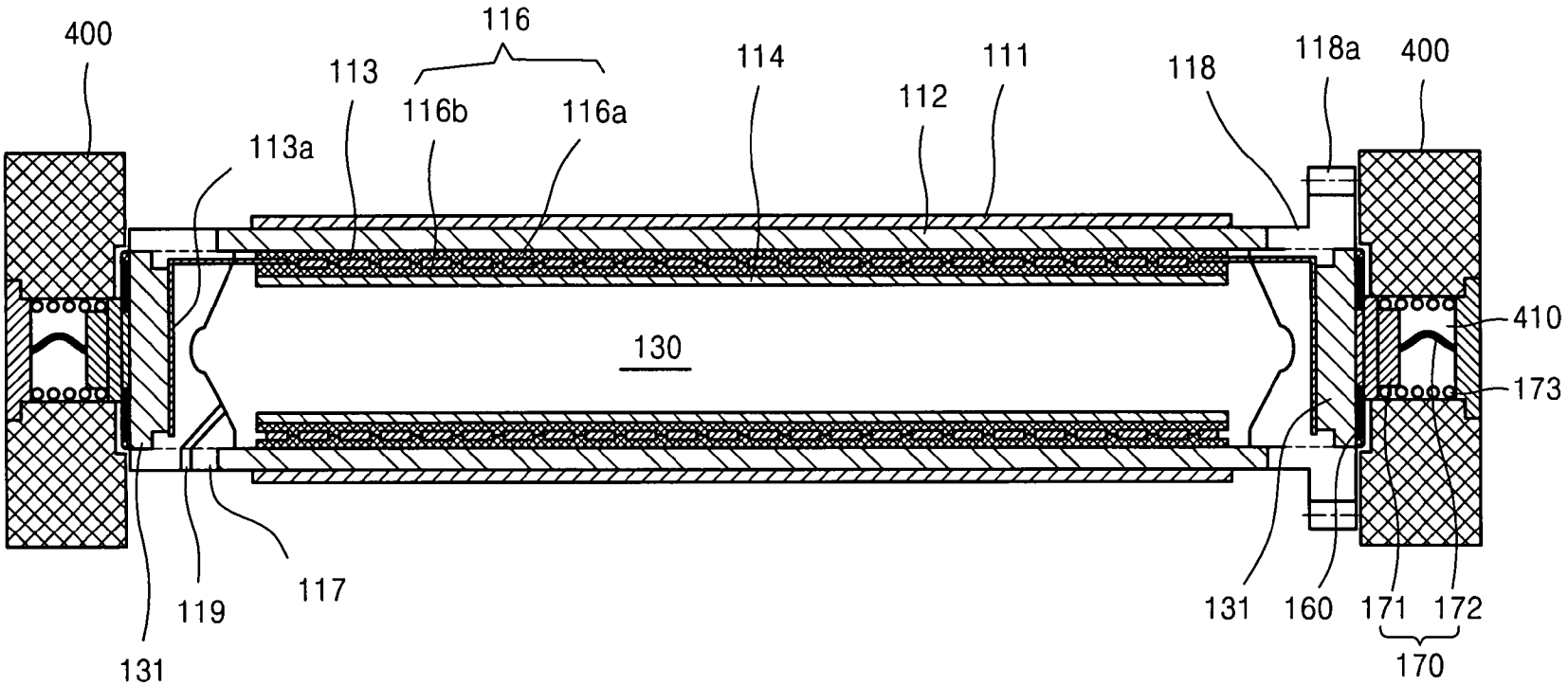
FIG. 3 is a transverse cross sectional view of a fusing unit according to an exemplary embodiment of the present invention.

Referring to FIGS. 2 and 3, a fusing apparatus 100 fuses a toner image 151 on a print medium 150 by applying heat and pressure to the toner image 151, and includes a fusing unit 110 for applying heat to the toner image 151 while rotating in a direction indicated by arrow A and a pressing roller 120 facing the fusing unit 110 for pressing the print medium 150 (on which the toner image 151 is transferred) passing therebetween toward the fusing unit 10 while rotating in a direction indicated by arrow B.

The fusing unit 110 includes a pipe-shaped fusing roller 112 to which a release layer 111 of which surface is coated with Teflon™ or the like is provided. A pipe-shaped internal pipe 114, which is open at both ends, is inserted in an inner portion of the fusing roller 112. A heating unit 113 is disposed between the fusing roller 112 and the internal pipe 114 and surrounds a circumferential surface of the internal pipe 114 in a spiral shape to generate heat with current supplied from an external power supply (not shown). An insulating portion 116 surrounds the heating unit 113 to insulate the internal pipe 114 from the fusing roller 112 to substantially prevent dielectric breakdown and leakage current at a time of applying current to the heating unit 113. The fusing roller 112 and the internal pipe 114 may be made of stainless steel, aluminum (Al), copper (Cu), or any other suitable material.

The heating unit 113 is preferably constructed with resistance heat generating coils for generating heat with current supplied from the external power supply (not shown), and lead portions 113*a* extending from the heating unit 113 to receive current from the external power supply are provided at both ends of the heating unit 113.

The insulating portion 116 includes a first insulating portion 116*a* disposed between the fusing roller 112 and the heating unit 113 and a second insulating portion 116*b* disposed between the heating unit 113 and the internal pipe 114. The insulating portion 116 transmits heat generated by the heating unit 113 and also has a withstand voltage characteristic and a characteristic of resistance to dielectric breakdown.

The withstand voltage characteristic denotes a characteristic of withstanding an applied predetermined external electric power. The characteristic of resistance to dielectric breakdown denotes a characteristic of not generating a leakage current of 10 mA or more without dielectric breakdown for one minute under a maximum withstand voltage of 3 kV. The withstand voltage characteristic is a standard that each insulating portion overcomes the applied withstand voltage of 3 kV to satisfy Canadian withstand voltage specifications defined by CSA (Canadian Standards Association) and European withstand voltage specifications.

An end cap 117 and a power transmission end cap 118 are disposed at both ends of the fusing roller 112, respectively. A construction of the power transmission end cap 118 is substantially similar to that of the end cap 117, but the power transmission end cap 118 is provided with power transmission means 118*a*, such as gears, that are connected to a motor unit (now shown) to rotate the fusing roller 112.

An air vent 119 is formed in the end cap 117. The air vent 119 allows external air to flow into an internal space 130 of the fusing roller 112 after the end cap 117 is installed in the fusing roller 112, so that the internal space 130 of the fusing roller 112 may be maintained at atmospheric pressure.

Therefore, although the internal pipe 114 is heated with heat transmitted from the heating unit 113, the internal space 130 may be maintained at atmospheric pressure due to the external air flowing through the air vent 119. The air vent 119 may be provided in the power transmission end cap 118. Alternatively, the air vent 119 may be provided in both the end cap 117 and the power transmission end cap 118.

Electrodes 131 are provided in the end cap 117 and the power transmission end cap 118. The electrodes 131 are electrically connected to the lead portions 113*a*. Current supplied by the external power supply is applied to the heating unit 113 through the power supply unit 170, the electrodes 131, and the lead portions 113*a*.

The fusing unit 110 includes a power supply unit 170 provided to a frame and supplying current to the electrode member 131 and a blocking member 160 blocking the supplied current when a temperature of the heat generating unit 113 abnormally increases.

The power supply unit 170 includes a brush 171, a connection portion 172, and an elastic member 173, such as a coil spring.

The brush 171 is disposed to slide in a guide hole 410 formed in the frame 400. One side of the brush 171 is connected to the connection portion 172 to receive the current supplied from an external power supply (not shown). A surface of the other side of the brush 171 is connected to the electrode member 131 to transmit the current supplied from the connection portion 172 to the electrode member. Ribs 171*a* protruding from the brush 171 are provided around the brush 171.

The connection portion 172 connects the external power supply (not shown) with the brush 171 to supply the current. Preferably, the connection portion 172 has sufficient length to accommodate the distance of the brush 171 sliding along the guide hole 410.

Figure 4:
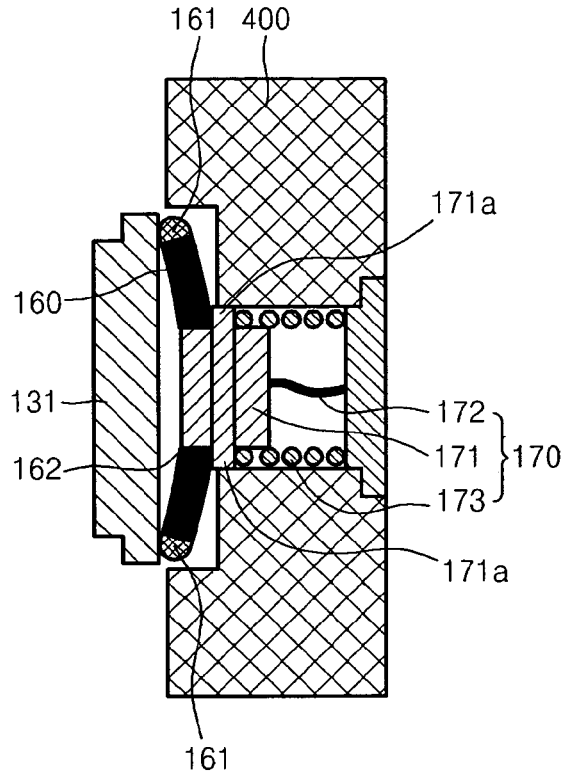
FIG. 4 is a partial cross sectional view of a blocking member according to an exemplary embodiment of the present invention.
Figure 5:
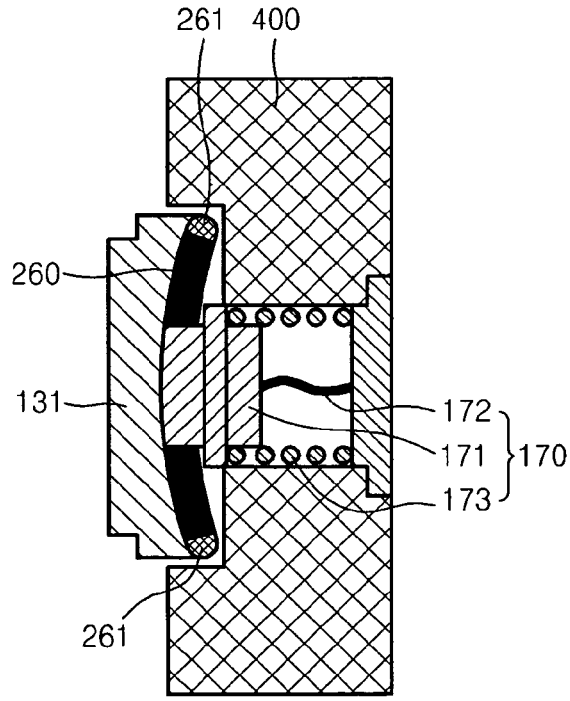
FIG. 5 is a partial cross sectional view of a blocking member according to another exemplary embodiment of the present invention.
Figure 6:
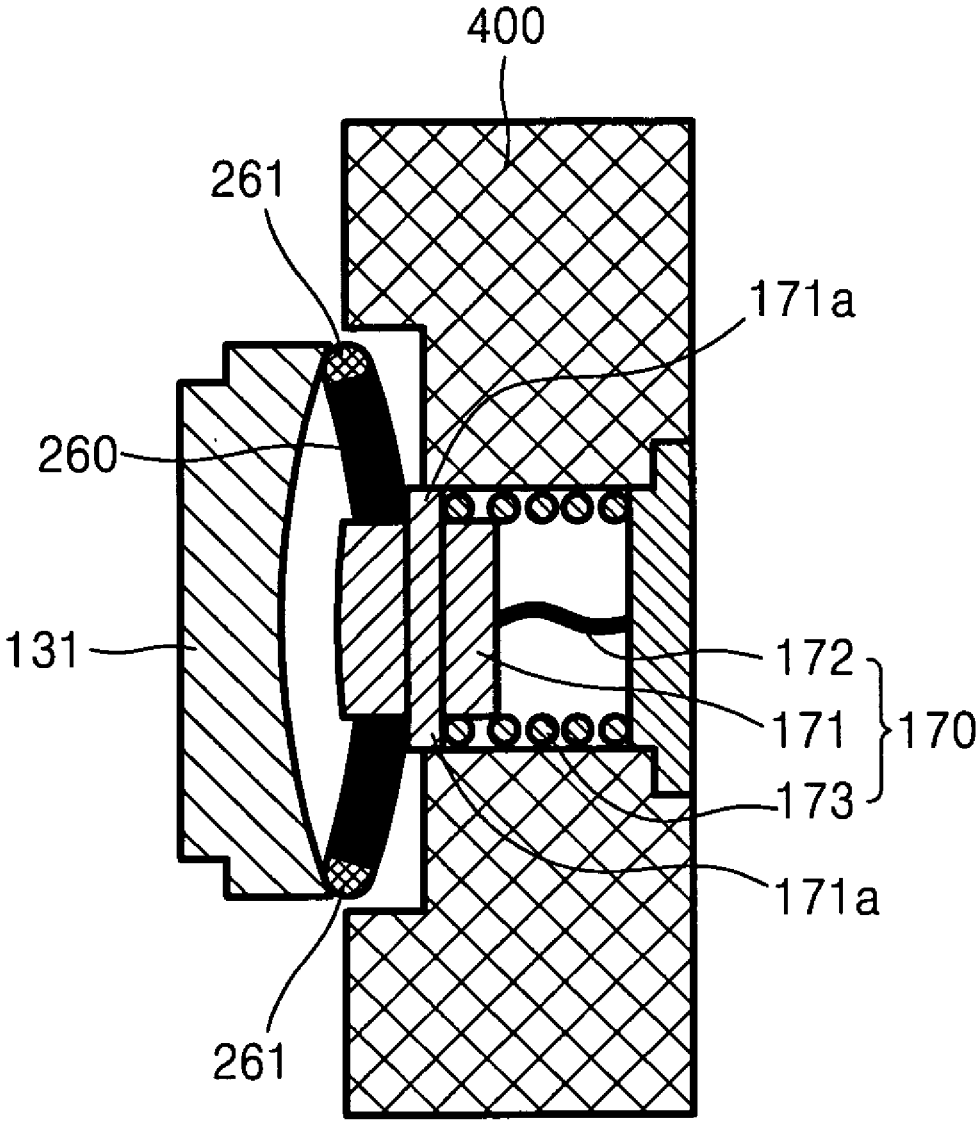
FIG. 6 is a partial cross sectional view of the blocking member of FIG. 5.

The elastic member 173 exerts an elastic force on the brush 171 toward the electrode member 131 and contacts the brush 171 with the electrode member 131, so that current may be continually applied without disconnection. For this reason, it is preferable that contact surfaces of the electrode members 131 and the brush 171 have shapes matching with each other. Referring to FIG. 4, the electrode member 150 and the brush 171 contact each other with a shape of a straight line. Referring to FIGS. 5 and 6, the electrode member 150 and the brush 171 contact each other with a shape of an arc.

The blocking member 160 disposed between the electrode member 131 and the brush 171 separates the brush 171 from the electrode member 131 to block the current applied to the electrode member 131 when the temperature of the heat generating unit 113 abnormally increases. Preferably, the block member 131 is constructed with a bimetal.

The bimetal is a member formed by attaching two metals having different thermal expansion coefficients, and when heat is applied one metal expands by any small amount of heat and the other metal does not easily expand, so that the bimetal is curved in one direction. Therefore, the bimetal is curved toward the brush 171 to separate the brush 171 from the electrode member 131, so that the current may be blocked.

Preferably, the blocking member 160 contacts the electrode member 131 with the same cross sectional area. This is because the heat transmitted from the heat generating unit 113 may be easily transmitted to the blocking member 160 by maximizing the contact area.

Additionally, as shown in FIGS. 4 to 6, it is preferable that the blocking member 160 has a shape of a straight line or an arc to correspond to the shape of the electrode member 131. This is because the heat may be easily transmitted by matching the shape of the blocking member 160 with the shape of the electrode member 131.

Among reference numerals shown in FIGS. 4 through 6, the reference numerals identical to the reference numerals shown in FIG. 3 denote the same members having the same functions, and thus, a description thereof is omitted.

A mounting hole 162 is formed at a center of the blocking member 160 so that the brush 171 may be inserted into the mounting hole 162. Therefore, the brush 171 is inserted into the mounting hole 162 to contact the electrode member 131, and the ribs 171*a* of the brush 171 collide with the edge of the mounting hole 162 to be engaged thereto by an interference fit. As a result, the brush 171 is supported by the mounting hole 162.

The blocking member 160 receives the elastic force by the brush 171 elastically biased toward the electrode member 131 by the elastic member 173 to contact the electrode member 131 with a contact area.

Operation of the blocking member 160 according to exemplary embodiments of the present invention is described below with reference to the drawings.

Referring to FIGS. 3 to 6, when the electrode member 131 and the brush 171 are connected to each other though the blocking member 160 as shown in FIGS. 3 and 5, when the temperature of the heat generating unit 113 abnormally increases, a temperature of portions of contacting lead portions 113*a* of the heat generating unit 113 and the electrode member 131 increases up to the highest value, and the heat is transmitted through the electrode member 131 to the blocking member 160.

As shown in FIGS. 4 and 6, the blocking member 160 overcomes the elastic force of the elastic member 173 to be bent toward the brush 171 due to the characteristic of the blocking member 160 and 260. At this time, the brush 171 also slides together with the blocking member 160 and 260 and is separated from the electrode member 131. Therefore, the current applied to the electrode member 131 may be blocked.

Although the blocking member 160 and 260 is bent toward the brush 171, the circumferential portion 161 of the blocking member 160 contacts the electrode member 131, so that the current may be transmitted through the circumferential portion 161 and 261 to the electrode member 131. Therefore, it is preferable that the circumferential portion 161 and 261 is subject to an insulation process to transmit heat and block current.

According to a fusing unit of exemplary embodiments of the present invention, current is blocked by using a blocking member, such as a bimetal having a rapid response to heat, so that a fire or the like caused by overheating may be substantially prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fusing unit, comprising:

a fusing roller including a heat generating unit; and electrode members disposed at each end of the fusing roller;

a power supply unit contacting each of the electrode members and supplying current thereto; and an expandable blocking member disposed between each of the electrode members and each the respective power supply units to block current by separating the power supply unit from the electrode members by expanding when a temperature of the heat generating unit rapidly increases.

2. The fusing unit according to claim 1, wherein each of the power supply units has a brush contacting the respective electrode member; and an elastic member exerting an elastic force on the brush to contact the electrode member.

3. The fusing unit according to claim 2, wherein the blocking member is constructed with a bimetal; and a mounting hole formed in the blocking member receives the brush to contact the electrode member.

4. The fusing unit according to claim 3, wherein each of the blocking members and the respective electrode members contact each other with substantially similar cross sectional areas.

5. The fusing unit according to claim 3, wherein a circumferential portion of the blocking member is insulated to block current and to transmit heat.

6. The fusing unit according to claim 3, wherein the brush has ribs that engage the blocking member by an interference fit.

7. The fusing unit according to claim 3, wherein each of the electrode members and respective blocking member have substantially corresponding shapes.

8. The fusing unit according to claim 3, wherein each of the electrode members and the respective brushes have substantially corresponding shapes.

9. The fusing unit according to claim 3, wherein the bimetal blocking member has a first metal proximal the brush and a second metal proximal the electrode member, the first metal having a higher thermal expansion coefficient such that upon application of heat the first metal causes the blocking member to curve toward the brush to separate the electrode member and the brush.

10. A fusing apparatus including a fusing unit for generating heat and a pressing roller for pressing a print medium on which a toner image is transferred and that passes through a contact portion between the fusing unit and the pressing roller toward the fusing unit, wherein the fusing unit comprises:

a fusing roller including a heat generating unit; and an electrode member disposed at each end of the fusing roller;

a power supply unit contacting each of the electrode members and supplying current thereto; and an expandable blocking member disposed between each of the electrode members and the respective power supply units to block current by separating the power supply unit from the electrode members by expanding when a temperature of the heat generating unit rapidly increases.

11. The fusing apparatus according to claim 10, wherein each of the power supply units includes a brush contacting the electrode member; and an elastic member exerting an elastic force on the brush to contact the electrode member, the blocking member being a bimetal and having a mounting hole formed at a center thereof to receive the brush to contact the electrode member.

12. The fusing apparatus according to claim 11, wherein each of the blocking members and the respective electrode members contact each other with substantially similar cross sectional areas.

13. The fusing apparatus according to claim 11, wherein a circumferential portion of the blocking member is insulated to substantially block current and to transmit heat.

14. The fusing apparatus according to claim 11, wherein the brush has ribs that engage the blocking member by an interference fit.

15. The fusing apparatus according to claim 11, wherein each of the electrode members and the respective blocking members have substantially corresponding shapes.

16. The fusing apparatus according to claim 11, wherein each of the electrode members and the respective brushes have substantially similar shapes.

17. The fusing apparatus according to claim 11, wherein the bimetal blocking member has a first metal proximal the brush and a second metal proximal the electrode member, the first metal having a higher thermal expansion coefficient such that upon application of heat the first metal causes the blocking member to curve toward the brush to separate the electrode member and the brush.

* * * * *